United States Patent [19]

Baysinger

[11] 4,104,016

[45] Aug. 1, 1978

[54] CYCLING PILOT BURNER CONTROL SYSTEM WITH SAFETY TIMING

[75] Inventor: Robert L. Baysinger, St. Louis, Mo.

[73] Assignee: Emerson Electric Co., St. Louis, Mo.

[21] Appl. No.: 803,072

[22] Filed: Jun. 3, 1977

[51] Int. Cl.[2] ..... F23Q 9/08

[52] U.S. Cl. ..... 431/54; 431/46; 431/69; 431/71

[58] Field of Search ..... 431/46, 54, 69, 71

[56] References Cited

U.S. PATENT DOCUMENTS 3,488,131 1/1970 Myers et al. ..... 431/69

*Primary Examiner*—Carroll B. Dority, Jr.
*Attorney, Agent, or Firm*—Paul A. Becker, Sr.

[57] ABSTRACT

A gas burner control system including a main burner and a pilot burner for igniting the main burner wherein the pilot burner is ignited only when the thermostat is calling for heat and wherein a normally closed bimetal operated safety switch is effective to provide a trial ignition period for igniting the pilot burner. An electrical resistance heater for effecting opening of the safety switch is in the gate cicuit of a solid-state switch and is energized in the absence of pilot burner flame. The solid-state switch, when conducting, is effective to complete an electrical circuit through the safety switch to open a first valve and initiate gas flow to the pilot burner. When pilot burner flame exists, the resistance heater is de-energized, the first valve is held open by means including a switch responsive to gas pressure downstream from the first valve, and a second valve, fluidically in the series with the first valve and controlling the flow of gas to the main burner, is opened.

5 Claims, 2 Drawing Figures

CYCLING PILOT BURNER CONTROL SYSTEM WITH SAFETY TIMING

This invention relates to electrically operated control systems for fluid fuel burners, and particularly to systems including safety means operative to supply fuel to a burner for a timed trial period during which ignition is attempted and to cut off the supply of fuel if ignition does not occur within the trial period.

Conventionally, gas burner control systems for space heating furnaces have used a continuously burning pilot. In these systems, a manual reset, thermoelectric safety valve is maintained open by a thermocouple heated by the pilot burner flame and controls all gas flow to the pilot burner and to a main burner. When a controlling space thermostat calls for heat, a valve downstream for the safety valve opens, allowing gas to flow to the main burner which is ignited by the pilot burner flame. Should the pilot burner flame be extinguished for any reason, the safety valve closes, cutting off the supply of gas to the pilot burner and thus also to the main burner. While such systems are considered safe in that all gas flow is terminated in the event of pilot outage, they are generally considered to waste gas because of the continously burning pilot.

To overcome the gas waste inherent in continuously burning pilot systems and yet maintain the desirable safety characteristics therein, various so-called "cycling pilot" systems have been developed in which the pilot burner is cycled on and off with the closing and opening of a thermostat, in which gas flow to the main burner occurs when a pilot burner flame exists but is precluded in the absence of a pilot burner flame, and in which safety means are provided to cut off the supply of gas if the pilot burner is not ignited within a predetermined timed trail period. A system of this general character is shown and described in U.S. Pat. No. 3,918,881.

An object of this invention is to provide a particularly simple, economical, and reliable gas burner control system employing a cycling pilot burner.

A further object of the invention is to provide an improved gas burner control system employing a cycling pilot burner and including a normally closed bimetal operated safety timer switch with an electrical resistance heater in which the electrical resistance heater is in the gate circuit of a controlled solid-state switching device, and in which an electrically operated valve controlling the flow of gas to the pilot burner is energized through the solid-state switching device, when rendered conductive, to initiate gas flow.

A further object is to provide a burner control system as in the foregoing paragraph, in which means responsive to pilot burner flame is effective to de-energize the electrical resistance heater and thus cause the solid-state switch to become non-conductive, and in which means responsive to the pressure of the gas supplied to the pilot burner is effective to maintain the energizing of the electrically operated valve after the solid-state switch becomes non-conductive.

Other objects and advantages will appear from the following description when read in connection with the accompanying drawings.

In the drawings:

FIG. 1 is a diagrammatic illustration of a burner control system constructed in accordance with the invention; and FIG. 2 is a cross-sectional view of the gas valve device employed in the control system.

DESCRIPTION OF THE PREFERRED EMBODIMENT

Figure 1:
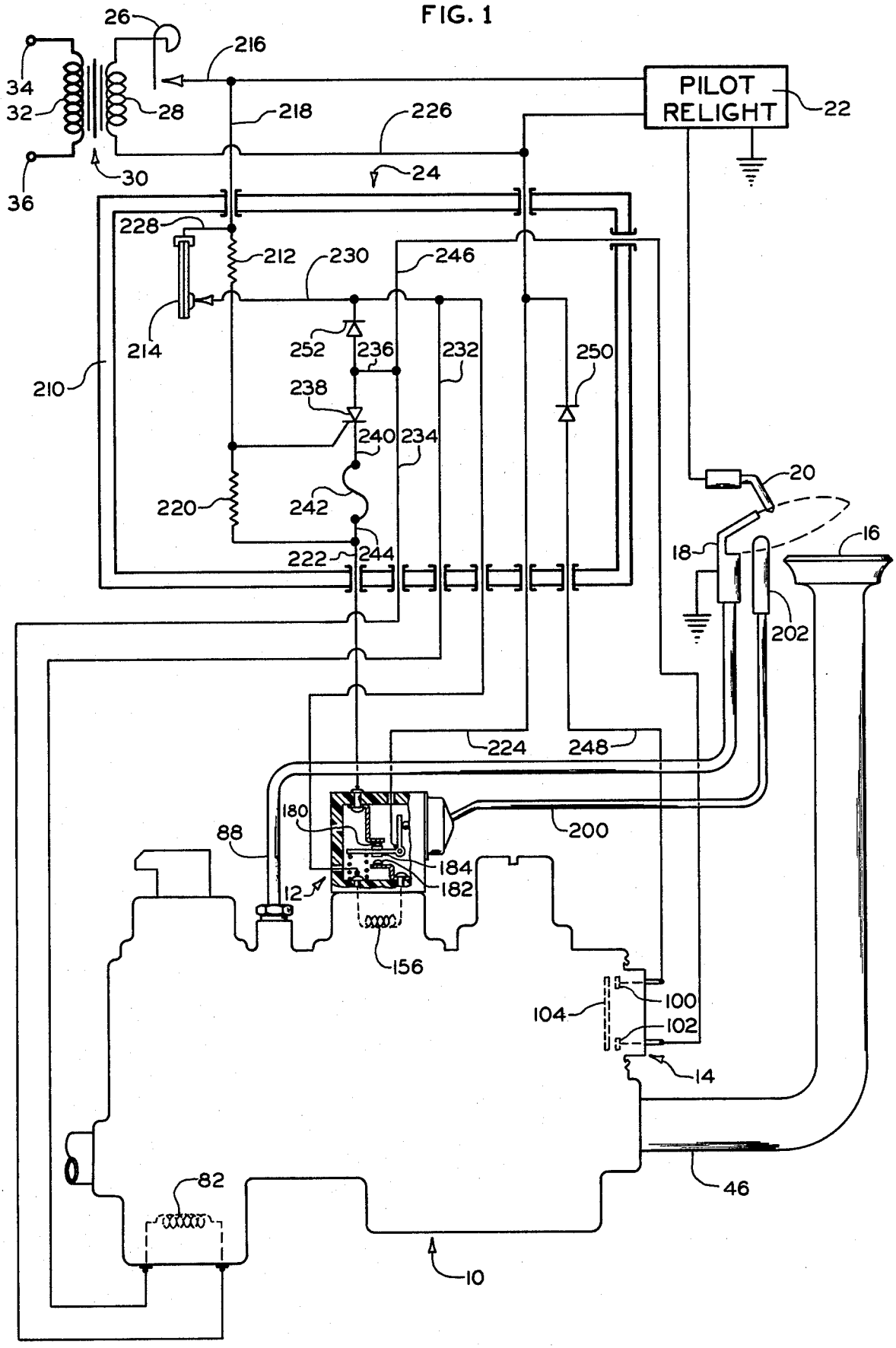

Referring to FIG. 1, the control system includes as primary elements, a manifold gas valve device generally indicated at 10 and including a thermostatically actuated switch 12 and a pressure actuated switch 14, a main burner 16, a pilot burner 18, a spark electrode 20, spark generating means 22, an electrical control device 24, and a space thermostat 26. The system is adapted to be electrically energized by the secondary winding 28 of a voltage step-down transformer 30 having its primary winding 32 connected across terminals 34 and 36 of a conventional 120 volt alternating current power source.

DESCRIPTION OF THE MANIFOLD GAS VALVE DEVICE

The manifold gas valve device 10 is the same as that disclosed in application Ser. No. 794,555, filed May 6, 1977, for CYCLING PILOT BURNER CONTROL SYSTEM WITH PRESSURE SWITCH, by Walter W. Scott, deceased, assignor to the assignee of the present invention.

Figure 2:
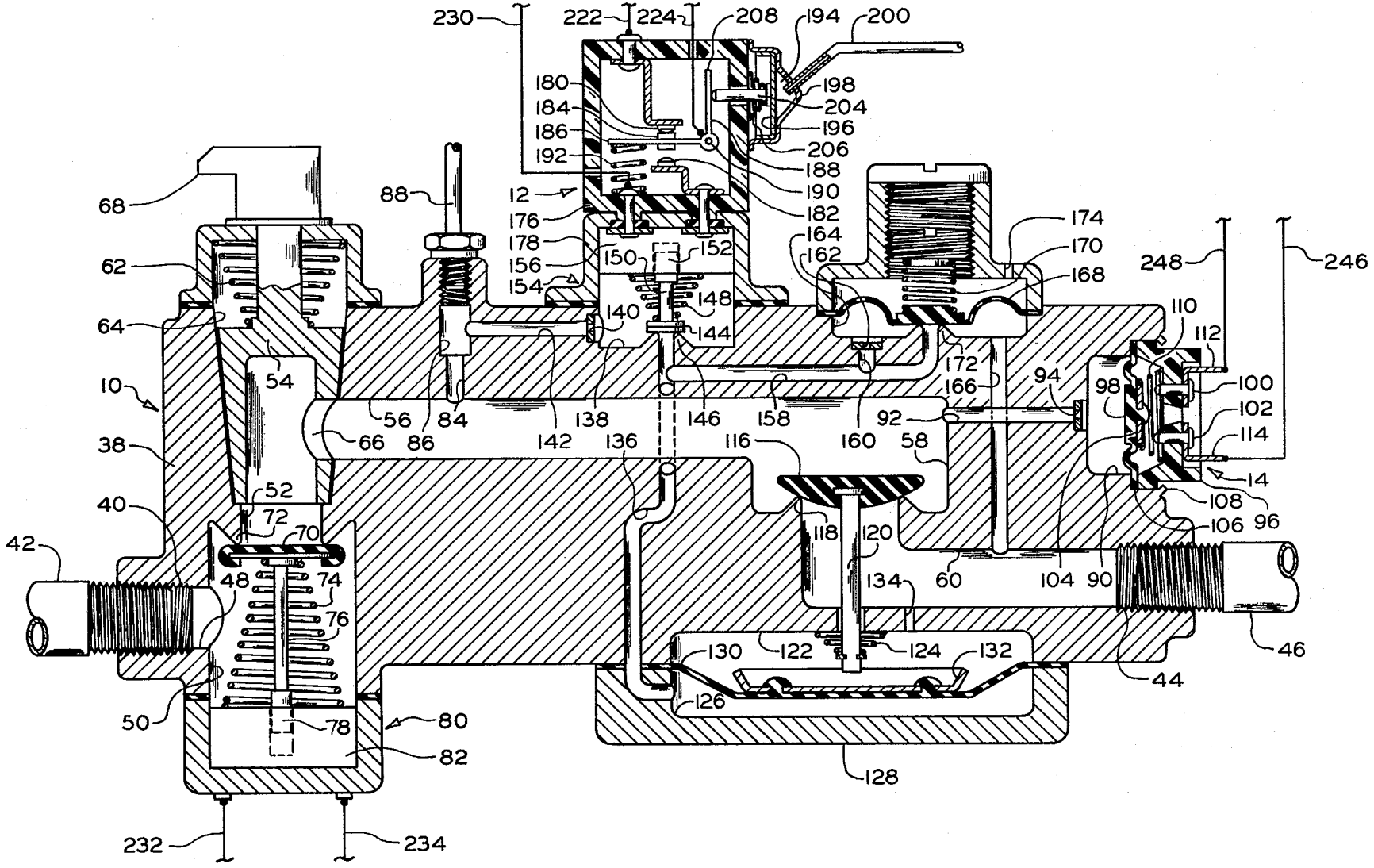

Referring to FIG. 2 of the drawings, the manifold gas valve device 10 comprises a body 38 having an inlet 40 receiving a gas supply conduit 42 and an outlet 44 receiving a gas conduit 46 leading to the main burner 16 shown in FIG. 1. Connecting inlet 40 and outlet 44 is a main fuel passageway means including an inlet passage 48, a chamber 50, a passage 52, a hollow rotary plug cock 54, a passage 56, a chamber 58, and an outlet passage 60.

Plug cock 54 is biased downwardly by a spring 62 into seating engagement in a vertical tapered bore 64 in body 38 and has a port 66 in the wall thereof which registers with passage 56 when the plug cock 54 is rotated by means of an attached knob 68 to an "on" position.

A biased closed electromagnetically opened primary control valve 70 cooperates with an annular seat 72 formed at the lower end of passage 52 to control all gas flow through the manifold valve device 10. The valve 70 is biased, closed on seat 72 by a spring 74 and has a stem 76 connected to the plunger 78 of a solenoid 80 having a winding 82. Valve 70 is opened when winding 82 is energized and is closed by spring 74 when winding 82 is de-energized.

Whenever valve 70 is open and plug cock 54 is in the "on" position wherein port 66 registers with passage 56, gas is supplied to the pilot burner 18 shown in FIG. 1 via passage 56, a passage 84, a chamber 86, and a conduit 88. Sparking occurs between electrode 20 and grounded conductive metal pilot burner 18 to ignite the gas. The spark generating means 22 for producing high voltage sparks may be of any suitable construction and arrangement and preferably includes means responsive to the occurrence of pilot flame to cut off the sparking. Spark generating means of this kind is disclosed in U.S. Pat. No. 3,894,273.

Also when valve 70 is open and plug cock 54 is in the "on" position, inlet gas pressure is supplied to a diaphragm chamber 90 to operate the pressure actuated switch 14, chamber 90 being in communication with chamber 58 through a passage 92 and an orifice 94. Chamber 90 is formed as a bottom portion of a stepped circular cavity in valve body 38. Secured in a larger diameter top portion of the stepped circular cavity is the pressure actuated switch 14.

Switch 14 comprises a rigid circular cup-shaped member 96 formed by dielectric material, a flexible circular diaphragm member 98 also formed of dielectric material, solid rivet type stationary contacts 100 and 102 spaced in cup member 96, and a movable contact 104 attached to the central portion of diaphgram member 98. Peripheral portions of the cup-shaped member 96 and the diaphragm member 98 are received in the stepped circular cavity with the peripheral portion of the diaphragm member 98 lying against an annular shoulder 106 formed between the bottom and top portions of the cavity and with the peripheral portion of the cup-shaped member 96 overlying the peripheral portion of diaphragm member 98. The peripheral portion of the cup-shaped member 96 is pressed against the diaphragm member 98 and shoulder 106 and held firmly fixed by staking as indicated at 108. The diaphragm member 98 and attached contact 104 are biased away from contacts 100 and 102 by a spring 110. Attached to stationary contacts 100 and 102 and extending outwardly therefrom are connector terminals 112 and 114, respectively.

A valve 116 cooperates with an annular valve seat 118 formed in chamber 58 for controlling gas flow to outlet passage 60 and the main burner 16. Valve 116 has a stem 120 extending downwardly into an upper diaphragm chamber 122 formed as a recess in valve body 38, and a spring 124 biases valve 116 downwardly to a closed position on its seat 118. A lower diaphragm chamber 126 is formed by a cup-shaped member 128 attached by any suitable means to valve body 38. A flexible diaphragm 130 is clamped at its periphery between body 38 and member 128 and forms a flexible wall between upper and lower diaphragm chambers 122 and 126, respectively. A relatively rigid disc 132 is centrally positioned and attached to diaphragm 130 and is effective to engage the lower end of valve stem 120 and move valve 116 upwardly toward an open position when sufficient gas pressure is applied to the lower side of diaphragm 130.

The upper diaphragm chamber 122 is adequately vented to outlet passage 60 through a vent 134 so that the upper side of diaphragm 130 is constantly exposed to the pressure existing in outlet passage 60. The lower diaphragm chamber 126 communicates with inlet passage 48 through a passage 136, a valve chamber 138, an orifice 140, a passage 142, chamber 86, passages 84 and 56, port 66, plug cock 54, passage 52, and chamber 50. A biased closed electromagnetically opened valve 144 cooperates with an annular valve seat 146 formed around the entrance of passage 136 into valve chamber 138 to control the admission of inlet gas to the lower diaphragm chamber 126. Valve 144 is biased closed on seat 146 by a spring 148 and has a stem 150 connected to the plunger 152 a solenoid 154 having a winding 156. Valve 144 is opened when winding 156 is energized and is closed by spring 148 when winding 156 is de-energized.

The gas pressure in the lower diaphragm chamber 126 which is applied to the lower side of diaphragm 130 is always something less than the supplied pressure at inlet 40 due to the pressure dropping orifice 140 and because of a constant and a variable bleed-off means between the passage 136 and outlet passages 60 through branch passage means. The branch passage means comprises passages 158 and 160, an orifice 162, a valve chamber 164, and a passage 166. The variable bleed-off means, which varies the bleed-off rate through passage 158 in response to outlet pressure variations so as to maintain some predetermined outlet pressure, comprises a diaphragm type pressure regulator valve 168 biased by an adjustable spring 170 toward a closed position on an annular seat 172 formed around the entrance of passage 158 into valve chamber 164. The side of valve 168 opposite that facing chamber 164 is exposed to atmospheric pressure through a vent 174.

The constant bleed-off means, which bypasses the pressure regulator valve 168 and provides a function to be later described, comprises passages 158 and 160, orifice 162, chamber 164, and passage 166.

Thermostatically actuated switch 12 comprises a casing 176 which, for convenience of illustration, is shown mounted on a housing member 178 of solenoid 154. A pair of stationary contacts 180 and 182 in switch 12 cooperate with a double-headed movable contact 184 to complete and break circuits to be hereinafter described. The movable contact 184 is mounted on one leg 186 of an L-shaped switch blade 188 pivoted on a pin 190, leg 186 extending between stationary contacts 180 and 182 to enable alternate engagement of movable contact 184 with stationary contacts 180 and 182. A spring 192 biases movable contact 184 against stationary contact 180 when switch 12 is in a "cold" position.

An expandible chamber 194 is defined by an inner flexible metal cup 196 and an outer rigid metal cup 198, cup 198 being attached to switch casing 176. Chamber 194 is connected by a capillary tube 200 to a bulb 202, shown in FIG. 1, mounted adjacent pilot burner 18. The expansible chamber 194, capillary tube 200, and bulb 202 comprise a sealed system filled with a thermally expansible fluid, such as mercury, with bulb 202 positioned so as to be impinged by the pilot flame.

An actuator rod 204 is biased at one end by a spring 206 against the inner flexible cup 196 and at its other end bears against the other leg 208 of the L-shaped switch blade 188. Upon expansion of the expansible chamber 194, actuator rod 204 causes pivoted switch blade 188 to pivot counterclockwise about pin 190, causing movable contact 184 to break from stationary contact 180 and make with stationary contact 182. When this switching is completed, switch 12 is in a "hot" position.

DESCRIPTION OF THE ELECTRICAL CONTROL DEVICE

The electrical control device indicated generally at 24 in FIG. 1 comprises a housing 210 having a plurality of openings through which electrical leads extend from components therein to the secondary winding 28 of transformer 30 and to the manifold gas valve device 10.

An electrical resistance heater 212 for controlling a normally closed bimetal operated safety switch 214 is connected across the secondary winding 28 of transformer 30 through thermostat 26, a lead 216, a lead 218, a gate bias resistor 220, a lead 222, stationary contact 180 and movable contact 184 of thermostatically actuated switch 12 when switch 12 is in its "cold" position shown, a lead 224, and a lead 226 back to the transformer secondary winding 28. In the preferred embodiment, the resistance heater 212 is of the type wherein a metallic film is deposited on the outside of a ceramic spool. This type of construction is one of several constructions recognized by Underwriters Laboratories, Inc., as being a construction wherein shorting is not one of its modes of failure.

Solenoid winding 82, which controls valve 70, shown in FIG. 1, and therefore all gas flow through valve device 10, is connected across the transformer secondary winding 28 through thermostat 26, leads 216 and 218, a lead 228, safety switch 214, a lead 230, a lead 232, winding 82, a lead 234, a lead 236, and SCR 238, a lead 240, a fusible link 242, a lead 244, lead 222, contacts 180 and 184 of switch 12, and leads 224 and 226 back to the transformer secondary winding 28. When contacts 100 and 102 in the pressure actuated switch 14 are closed by movable contact 104, a circuit paralleling SCR 238, fusible link 242, and contacts 180 and 184 in switch 12 is provided, the circuit being a lead 246, contacts 102, 104, and 100 in switch 14, a lead 248, and a diode 250. As will be later described, this parallel circuit provides a holding circuit for solenoid winding 82 after contacts 180 and 184 in switch 12 are disconnected.

A diode 252 is connected in opposed polarity to SCR 238 between leads 230 and 236. Diode 252 provides a shorted low impedance path in the event that SCR 238 shorts between its anode and cathode. Specifically, if SCR 238 shorts, a circuit between leads 226 and 216 would be completed through lead 224, contacts 184 and 180 of switch 12, leads 222 and 244, fusible link 242, lead 240, shorted SCR 238, diode 252, lead 230, safety switch 214, and leads 228 and 218. Under these conditions, fusible link would open due to the large quantity of current flow and therefore prevent the initial energizing of solenoid winding 82 through SCR 238. Under normal conditions, diode 252 permits continued current flow through solenoid winding 82 occasioned by the winding inductance when SCR 238 cuts off and when diode 250 blocks the flow of current, this occurring each half cycle when lead 226 is positive, thereby enabling the solenoid winding 82 to remain energized.

Diode 250 prevents a short circuit from occurring between leads 226 and 216 each half cycle that lead 226 is positive and when the pressure actuated switch 14 has its contacts closed. Specifically, such a short circuit would be from lead 226, leads 224 and 248, switch contacts 100, 104, and 102, leads 246 and 236, diode 252, lead 230, safety switch 214, and leads 228 and 218 to lead 216.

When the thermostatically actuated switch 12 is in its "hot" position, wherein contacts 180 and 184 are open and contacts 182 and 184 are closed, solenoid winding 156 is connected across the transformer secondary winding 28 through thermostat 26, leads 216, 218, and 228, safety switch 214, lead 230, winding 156, contacts 182 and 184 of switch 12, and leads 224 and 226 back to the transformer secondary winding 28. As will be hereinafter described, the energizing of solenoid winding 156 enables gas to flow to the main burner 16.

The spark generating means 22 is connected across the transformer secondary winding 28 through thermostat 26 and lead 216 and 226.

OPERATION OF THE SYSTEM

The gas valve device 10 is shown in FIG. 2 with electromagnetically operated valves 70 and 144 and pressure operated valve 116 all biased closed and thermostatically actuated swtich 12 in its "cold" position but with plug cock 54 rotated to the "on" position. Under these conditions, the closing of thermostat 26 in FIG. 1 causes safety switch resistance heater 212 and resistor 220 to be connected across the transformer secondary winding 28 through thermostat 26, leads 216, 218, and 222, "cold" contacts 180 and 184 of switch 12, and leads 224 and 226. The resulting voltage on the gate of SCR 238 due to current flow through resistance heater 212 and gate bias resistor 220 effects the firing of SCR 238. With SCR 238 conducting, solenoid winding 82 is connected across the transformer secondary winding 28 through thermostat 26, leads 216, 218, and 228, safety switch 214, leads 230, 232, 234, and 236, SCR 238, lead 240, fusible link 242, leads 244 and 222, contacts 180 and 184 of switch 12, and leads 224 and 226. The closing of thermostat 26 also concurrently connects the spark generating means 22 across the transformer secondary winding 28 through thermostat 26 and leads 216 and 226. Therefore, valve 70 is opened, permitting gas to flow to the pilot burner 18, ignition of the gas is attempted by sparks produced between electrode 20 and pilot burner 18, and the resistance heater 212 is heating.

When ignition of the pilot burner 18 occurs and the bulb 202 subsequently becomes sufficiently heated by the pilot burner flame to expand expansible chamber 194 to cause contacts 180 and 184 to open and contacts 182 and 184 to close, the electromagnetically operated valve 144 is opened, winding 156 controlling valve 144 being energized by the transformer secondary winding 28 through the thermostat 26, leads 216, 218, and 228, safety switch 214, lead 230, contacts 182 and 184, and leads 224 and 226.

The opening of valve 70 also permits gas to flow to chamber 90 in valve device 10. The gas pressure in chamber 90 causes the flexible diaphragm 98 in the pressure actuated switch 14 to move outwardly against the bias of spring 110 to effect the connection of stationary contacts 100 and 102 by movable contact 104. Therefore, when contacts 180 and 184 are open, valve 70 remains open due to the parallel holding circuit provided by lead 246, contacts 102, 104, and 100 in the pressure actuated switch 14, lead 248, and diode 250. Also, when contacts 180 and 184 are open, resistance heater 212 is completely de-energized.

Referring to FIG. 2, opening of valve 144 permits gas to flow to the lower diaphragm chamber portion 126 increasing the pressure therein and causing valve 116 to be opened. Gas now flows to the main burner 16 to be ignited by the pilot burner flame. The pressure in lower diaphragm chamber portion 126 and consequently, the degree of opening of valve 116, will be regulated by regulator valve 168 to maintain a predetermined outlet pressure in passage 60. The main burner 16 and pilot burner 18 will continue to burn until thermostat 26 opens, whereupon electromagnetically operated valves 70 and 144 instantly close and valve 116 closes immediately thereafter. When valves 70 and 144 close, the existing pressure in lower diaphragm chamber portion 126 immediately exhausts to outlet passage 60 through passages 136, 158, and 160, orifice 162, chamber 164, and passage 166, permitting immediate closure of valve 116 under the bias of spring 124. The orifice 140 at the entrance of valve chamber 138 is sufficiently larger than the constant bleed-off orifice 162 to maintain sufficient operating pressure in lower diaphragm chamber portion 126 when valve 144 is open. The purpose of orifice 140 is to limit the operating pressure to a range wherein the pressure regulator valve 168 will operate accurately.

If during normal burner operation the electrical power source fails, valves 70, 144, and 116 close, causing all gas flow through valve device 10 to cease. The cessation of gas flow causes the extinguishing of pilot burner flame and main burner flame and causes contacts 100 and 102 in the pressure actuated switch 14 to open. Upon resumption of electrical power, the primary control valve 70 is prevented from opening until the thermostatically actuated switch 12 has cooled sufficiently to close its "cold" contacts 180 and 184.

If during normal burner operation, the gas supply fails, to pilot burner flame and main burner flame are extinguished and contacts 100 and 102 is the pressure actuated switch 14 are opened. Since during normal burner operation the thermostatically actuated switch 12 is in its "hot" position wherein contacts 180 and 184 are open and solenoid winding 82 is energized through contacts 100, 102, and 104 of the pressure actuated switch 14, the diconnection of contacts 100 and 102 causes the primary control valve 70 to close. Upon resumption of the gas supply, the primary control valve 70 is prevented from opening until the thermostatically actuated switch 12 has cooled sufficiently to close its "cold" contacts 180 and 184.

Therefore, the simultaneous flow of unignited gas to the pilot burner 18 and main burner 16 upon restoration of electrical power following a short period of period of an electrical power failure and upon restoration of the gas supply following a short period of a gas supply failure is prevented by the pressure actuated switch 14. The prevention of this simultaneous flow condition is considered desirable in that, when the burners are enclosed within the confines of a combustion chamber, even a slight delay in the ignition of the pilot burner would present a potentially hazardous condition.

If upon starting burner operation in response to closure of thermostat 26, the pilot burner 18 fails to ignite or fails to provide an adequate flame to heat bulb 202, the thermostatically actuated switch 12 will remain in its "cold" position and resistance heater 212, due to the current flow therethrough, causes safety switch 214 to open after a predetermined time, thereby de-energizing solenoid winding 82 and effecting the closing of valve 70. Resistance heater 212 remains energized and safety switch 214 remains open until thermostat 26 opens. When thermostat 26 opens, resistance heater 212 is de-energized and cools, allowing safety switch 214 to close.

If upon starting burner operation in response to closure of thermostat 26, the resistance heater 212 is open, the SCR 238 cannot be gated and therefore, solenoid winding 82 cannot be energized. The resistance heater 212 being in the gate circuit of the SCR 238 therefore ensures, prior to allowing gas to flow, that the resistance heater 212 is operational.

It should be noted that in the above described system, the resistance heater 212 is completely de-energized when the thermostatically actuated switch 12 is in its "hot" position. This enables the resistance heater 212 to cool sufficiently while the main burner 16 is on so that the timed trial periods for successive burner operations are consistent.

While the invention has been illustrated and described in detail in the drawings and foregoing description, it will be recognized that many changes and modifications will occur to those skilled in the art. For example, safety switch 214 could include a latch (not shown) which would require manually resetting the safety switch 214 to a closed position. Also, the ignition means could be, for example, a flow igniter instead of a spark igniter, and the ignition means could be operated on 120 volts instead of on a lower voltage as shown. It is therefore intended, by the appended claims, to cover any such changes and modifications as fall within the true spirit and scope of the invention.

I claim:

1. In a fuel burner control system, control means including an electrical winding for controlling the flow of fuel to a burner;

means for igniting said burner;

a normally closed bimetal operated safety switch having an electrical resistance heater which, when energized for a predetermined time period, effects opening of said safety switch:

a solid-state switch having a control electrode;

gating circuit means including said resistance heater connected to said control electrode of said solid-state switch for controlling the conduction thereof;

control circuit means including said safety switch, said winding, and said solid-state switch connected in series for controlling initial flow of fuel to said burner;

flame responsive means for effecting energizing of both said circuit means in the absence of a burner flame whereby said resistance heater is energized and said electrical winding is energized to initiate the flow of fuel to said burner, and for effecting de-energizing of both said circuit means when said burner flame exists whereby said resistance heater is de-energized; and means connected to said electrical winding for maintaining energizing thereof when said flame responsive means effects de-energizing of both said circuit means.

2. In a gas burner control system, an electrical power source;

a burner;

a space thermostat;

electrically operated ignition means controlled by said thermostat for igniting said burner;

a normally closed electromagnetically operated valve controlling the flow of gas to said burner and having an electrical winding;

a solid-state switch having a control electrode;

a flame responsive switch having a cold position in the absence of a burner flame and a hot position when said burner flame exists;

a normally closed bimetal operated safety switch having an electrical resistance heater which, when energized for a predetermined time period, effects opening of said safety switch;

circuit connections connecting said safety switch, said winding, said solid-state switch, and said flame responsive switch in said cold position in series across said power source through said thermostat for effecting opening of said valve;

circuit connections connecting said resistance heater and said flame responsive switch in said cold position in series across said power source through said thermostat for effecting heating of said resistance heater;

switch means connected in parallel with said solid-state switch and said flame responsive switch in said cold position and responsive to gas pressure existing downstream from said valve when said valve is open for maintaining energizing of said winding when said flame responsive switch is in said hot position; and circuit connections connecting said resistance heater to said control electrode of said solid-state switch so that said resistance heater is effective, when energized, to gate said solid-state switch and render said solid-state switch conductive which enables said valve to open and, in the absence of said burner flame, to remain open only for said predetermined time period.

3. The gas burner control system claimed in claim 2 wherein said solid-state switch is an SCR.

4. In a gas burner control system, an A.C. power source;

a space thermostat;

a pilot burner;

a main burner disposed to be ignited by said pilot burner;

a gas valve device comprising first and second valves;

said first valve controlling the flow of gas to said pilot burner and to said main burner;

said second valve being fluidically in series with said first valve and controlling the flow of gas to said main burner;

electrically operated means including a first winding for controlling operation of said first valve;

electrically operated means including a second winding for controlling operation of said second valve;

electrically operated ignition means connected across said power source through said thermostat for igniting said pilot burner;

a solid-state switch having a control electrode;

a normally closed bimetal operated safety switch having an electrical resistance heater which, when energized for a predetermined time period, effects opening of said safety switch;

a double-throw thermostatically actuated switch having a cold position in the absence of a pilot burner flame and a hot position when said pilot burner flame exists;

first circuit connections connecting said safety switch, said first winding, said solid-state switch, and said thermostatically actuated switch in said cold position in series across said power source through said thermostat for effecting opening of said first valve;

second circuit connections connecting said resistance heater, a resistor, and said thermostatically actuated switch in said cold position in series across said power source through said thermostat for effecting heating of said resistance heater in the absence of said pilot burner flame;

third circuit connections connecting said safety switch, said second winding, and said thermostatically actuated switch in said hot position in series across said power source through said thermostat for effecting opening of said second valve;

a pressure actuated switch connected in parallel with said solid-state switch and said thermostatically actuated switch in said cold position and actuated to a closed contact position in response to gas pressure when said first valve is opened for maintaining said first valve in an open position when said thermostatically actuated switch is in said hot position;

said control electrode of said solid-state switch being connected to a point between said resistance heater and said resistor whereby said heater and said resistor comprise a gating circuit for said solid-state switch; and said solid-state switch being rendered conductive by said resistance heater in the absence of said pilot burner flame to effect opening of said first valve and being rendered non-conductive by the opening of said safety switch in the absence of said pilot burner flame after said predetermined time period to effect closing of said first valve.

5. The gas burner control system claimed in claim 4 wherein said solid-state switch is an SCR and further including a first diode connected between said safety switch and said SCR in opposed polarity to said SCR and a second diode connected in series with said pressure switch in opposed polarity to said first diode.

* * * * *